United States Patent [19]

Schumacher

[11] Patent Number: 5,019,752

[45] Date of Patent: May 28, 1991

[54] PLASMA SWITCH WITH CHROME, PERTURBATED COLD CATHODE

[75] Inventor: Robert W. Schumacher, Canoga Park, Calif.

[73] Assignee: Hughes Aircraft Company, Los Angeles, Calif.

[21] Appl. No.: 207,603

[22] Filed: Jun. 16, 1988

[51] Int. Cl.[5] ..... H01J 1/32; H01J 17/14; H01J 15/02

[52] U.S. Cl. ..... 315/344; 313/162; 313/231.41; 313/311; 313/351; 315/111.01

[58] Field of Search ..... 315/334–338, 315/111.01, 344; 313/161, 162, 311, 362.1, 632, 103, 104, 231.41, 351

[56] References Cited

U.S. PATENT DOCUMENTS

| | | | |
|---|---|---|---|
| 1,872,359 | 10/1927 | Sutherlin | 313/311 |
| 3,596,131 | 7/1971 | Wilczek | 313/103 R |
| 4,247,804 | 1/1981 | Harvey | 315/344 |
| 4,394,622 | 7/1983 | Rink | 315/336 |
| 4,596,945 | 6/1986 | Schumacher et al. | 315/344 |
| 4,611,147 | 9/1986 | Hatch et al. | 313/550 |

FOREIGN PATENT DOCUMENTS

| | | |
|---|---|---|
| 0210858 | 2/1987 | European Pat. Off. . |
| 8505489 | 12/1985 | World Int. Prop. O. . |

OTHER PUBLICATIONS

Schumacher et al., "Low-Pressure Plasma Opening Switches", chapter in text edited by Guenther et al., Opening Switches, Plenum Publishing Corp., 1987, pp. 93–129.

Caron, "A Helium Plasma Simulator", Proceedings of the IEEE, vol. 59, No. 4, Apr. 1971, pp. 608–613.

Goldberg et al., "Hydrogen Thyratrons", chapter in Advances in Electronics and Electron Physics, ed. L. Morton, vol. XIV, Academic Press, 1961, pp. 207–219.

Alessi et al., "Regular and Asymmetric Negative Ion Magnetron with Grooved Cathodes", Rev. Sci. Instrum., vol. 51, No. 12, Dec., 1980, pp. 1630–1633.

Stipp et al., "A Brighter H− Source for the Intense Pulse Neutron Source Accelerator System", IEEE Transactions on Nuclear Science, vol. NS-30, No. 4, Aug. 1983, pp. 2743–2745.

Martinelli, "Effects of Cathode Bumpiness on the Spatial Resolution of Proximity Focused Image Tubes", Applied Optics, vol. 12, No. 8, Aug. 1973, pp. 1841–1845.

P. R. Caron, "Plasma Generation Using a Large V--Groove Cathode Discharge", Appl. Sci. Res. 23, Mar. 1971, pp. 409–425.

James G. Alessi, "A Circular Aperture Magnetron for Injection into an RFQ", American Institute of Physics Conference Proceedings No. 158, Particles and Fields Series 35, Production and Neutralization of Negative Ions and Beams, Fourth International Symposium, Brookhaven, N.Y., 1986, pp. 419–424.

C. W. Schmidt et al., "Operation of the Fermilab H− Magnetron Source", American Institute of Physics Conference Proceedings No. 158, Particles and Fields Series 35, Production and Neutralization of Negative Ions and Beams, Fourth International Symposium, Brookhaven, N.Y., 1986, pp. 425–429.

R. L. Witkover, "Operational Experience with the BNL Magnetron H− Source", American Institute of Physics Proceedings, 1984, pp. 398–409.

J. R. Hechtel et al., "A Dual Mode Electron Gun Having Non-Intercepting Grids", International Electron Devices Meeting Technical Digest, 1973, pp. 171–174.

B. B. Baker, "High Efficiency Emission Mechanisms in Not Cathode Low Pressure Discharges", International Journal of Electronics, vol. 25, No. 1, 1968, pp. 49–56.

*Primary Examiner*—Eugene R. LaRoche

*Assistant Examiner*—M. Shingleton

*Attorney, Agent, or Firm*—V. D. Duraiswamy; W. K. Denson-Low

[57] ABSTRACT

A plasma switch employs a cold cathode which yields secondary electrons to sustain a plasma within the switch. The cathode is provided with a series of perturbations which increase the effective cathode surface area exposed to the plasma and increase the average effective path lengths of secondary electrons emitted from the cathode and the probability of such electrons having ionizing collisions with gas molecules within the switch. The interior cathode surface is provided with a coating formed from chromium or a chromium mixture. Chromium combines a high rate of secondary electron emission with low sputtering and other advantageous properties for plasma switch operation. Various types of chromium-plated perturbations are described.

36 Claims, 6 Drawing Sheets

PRIOR ART

PLASMA SWITCH WITH CHROME, PERTURBATED COLD CATHODE

BACKGROUND OF THE INVENTION

1. Field of the Invention

This invention relates to crossed-field plasma switches, and to cold cathodes used therein.

2. Description of the Related Art

A low pressure plasma opening switch, referred to as the CROSSATRON Modulator Switch (CROSSATRON is a trademark of Hughes Aircraft Company, the assignee of the present invention), has recently been developed. Details of this switch are provided in U.S. Pat. No. 4,596,945 by Schumacher, et al., assigned to Hughes Aircraft Company, and in a text edited by Guenther, et al., *Opening Switches*, chapter entitled "Low-Pressure Plasma Opening Switches", Schumacher, et al., pages 93–129, Plenum Publishing Corp., 1987. The switch is a secondary-electron-emitter, cold cathode device which employs a controlled diffuse discharge to both close and open pulsed-power circuits at high speed and high repetition frequency. In contrast to prior DC-current opening-switch devices such as hard-vacuum tetrodes, the low-pressure plasma opening switch described by Schumacher eliminates the need for a cathode heater, and offers instant starting, long life, low forward voltage drop, high current conduction and electromechanically rugged operation.

The basic configuration of the switch is illustrated in FIG. 1. The switch is based upon a crossed-field discharge in a four element, coaxial system consisting of a cold cathode 2, an anode 4, and a source grid 6 and control grid 8 between the cold cathode 2 and anode 4. These elements are cylindrical in shape; FIG. 1 depicts a sectional view on one side of the device center line.

Charges for conduction are generated by a plasma discharge near the cathode. The plasma is produced by a crossed-field cold cathode discharge in a gap located between the source grid 6 (which serves as an anode for the local cross-field discharge) and the cathode 2. The gap is magnetized with a cusped field supplied by permanent magnets 10 attached to the outside of the switch. This arrangement eliminates the need for cathode heater power, and also permits instant start operation.

The source plasma 12 is generated by pulsing the potential of the source grid 6 to a level above 500 volts for a few microseconds to establish a crossed-field discharge. When equilibrium is reached, the source grid potential drops to the low discharge level about 500 volts above the potential of cold cathode 2. With the control grid 8 remaining at the cathode potential, the switch remains open and the full anode voltage appears across the vacuum gap between the control grid 8 and the anode 4.

The switch is closed by releasing the control grid 8 potential, or by pulsing it momentarily above the 500 volt plasma potential. This allows plasma to flow through the source grid 6 and control grid 8 to the anode 4. Electrons from the plasma are collected by the anode, the switch conducts, and the anode voltage falls to the 500 volt level. To open the device, the control grid 8 is returned to the cathode potential or below in a hard tube fashion.

Once a glow discharge has been initiated, it is maintained as illustrated in FIG. 2 by secondary electron emission from the cold cathode. This is illustrated in FIG. 2, which plots the steady state, glow-discharge potential distribution between the cathode and anode. The plasma potential relative to the cathode is generally 200–1,000 volts, depending upon the gas species and electrode materials used, as well as the current density at the cathode. Ions are collected from the plasma in the gap across non-neutral sheath regions 14, 16 at both the cathode and anode, respectively. Electrons, however, are collected at the anode only. The plasma maintains a small anode-sheath voltage drop to adjust the ambipolar flux of electrons and ions so that the plasma remains electrically neutral. Most of the potential drop across the switch occurs at the cathode sheath 14, where ions are accelerated to kinetic energy levels sufficient to stimulate the emission of secondary electrons from the cathode surface. The total cathode current is thus the sum of the ion current collected from the plasma (current flow 18), and the emitted secondary-electron current from the cathode (current flow 20). Electrons from the plasma are repelled by the cathode potential, and cannot cross the cathode sheath 14 to reach the cathode (current path 22).

Following their emission from the cathode, the secondary electrons are accelerated through the cathode sheath 14 and enter the plasma at an energy corresponding to the 200–1,000 volt cathode sheath drop. The magnetic field traps these electrons in a spiral between the cathode and anode, causing them to undergo ionizing collisions with the background neutral gas atoms in the plasma before they are collected by the anode. In the steady state, the rate of ionization from these collisions balances the ion loss rate to the cathode and anode such that the glow-discharge plasma is maintained at a constant level.

The cold cathode has typically been formed from a high strength, relatively inexpensive stainless steel or copper tube, with a smooth-bore refractory metal sheet, typically molybdenum, vacuum oven brazed to the inside surface of the tube to provide an electron-emissive surface facing the plasma. This process is expensive because the large area braze requires a significant amount of gold-based braze material, vacuum oven time, and tooling. Process yield has also not been satisfactory because of differences in the thermal expansion properties of the refractory metal sheet and underlying tube material. For example, molybdenum and copper have different rates of thermal expansion. The molybdenum sheet is brazed to the tube at a temperature of about 950° C., but when the sheet cools, it contracts less than the underlying copper tube. This process produces wrinkles in the molybdenum sheet, a poor bond, and trapped pockets of air and gold braze.

The efficiencies achieved with such switches have also not been optimum. The efficiency is directly proportional to the forward voltage drop across the switch. The forward drop could theoretically be reduced by increasing the secondary electron yield from the cold cathode and/or increasing the dwell time of the secondary electrons within the plasma, thereby increasing the probability of an electron colliding with and ionizing a gas molecule before being captured by the anode. With a plasma potential of 500 volts, current switches achieve a secondary electron yield of only about 0.2 per ion striking the cathode wall. While the secondary electron yield could in principle be increased by coating the cathode with a very low work function material, such materials are normally sputtered away by the plasma ions which strike the cathode. Although molybdenum is most frequently used as a cathode coating, it is expensive and difficult to work with.

SUMMARY OF THE INVENTION

The present invention seeks to provide a plasma switch which has a greater efficiency and lower forward-voltage drop than prior switches, is relatively inexpensive and easy to construct, is operational over a wide temperature range, and is not subject to significant sputter problems.

Such a switch is achieved by providing the cold cathode with a series of perturbations which increase the effective cathode surface area exposed to the plasma, and by providing the cathode with a surface layer which is at least partially formed from the refractory metal chromium. The perturbations also electrostatically confine the secondary electrons emitted from the cathode, thus increasing their effective path length through the plasma and the probability of striking a gas molecule. The higher cathode surface area reduces the cathode current density and further reduces the forward voltage drop.

The perturbations may be provided as a series of parallel grooves in the cathode, the widths of which should be at least twice the width of the cathode sheath. They may also comprise cavities in the cathode having openings to the plasma which are substantially smaller than the cavity interiors; such cavities may be formed by overlapping the cathode surface between grooves with a series of crossbars which partially close the cavities.

Chromium has been found to increase the secondary electron yield and to have other properties that make it particularly advantageous for use in a plasma switch. The chromium surface layer may be formed from chromium with a purity exceeding 99%, from a mixture of chromium and chromium oxide, or from a mixture of chromium and either tungsten, molybdenum or thorium.

These and other features and advantages of the invention will be apparent to those skilled in the art from the following detailed description of various preferred embodiments, taken together with the accompanying drawings, in which:

DETAILED DESCRIPTION OF PREFERRED EMBODIMENTS

The present invention increases the efficiency and reduces the forward-voltage drop of plasma switches by providing the cold cathode with a series of perturbations that increase the effective path length of electrons through the plasma, increase the cathode area, reduce the cathode current density, and by forming the cold cathode with a secondary electron emissive surface that at least partially comprises a chromium bearing material. Despite over 20 years of work with plasma switches, chromium is not known to have been previously considered for use in a cold cathode for such a switch. However, chromium has been found to yield better switch production and operation than other materials that have been used for a considerable period of time, particularly when combined with the perturbated cathode of the present invention.

Figure 3:
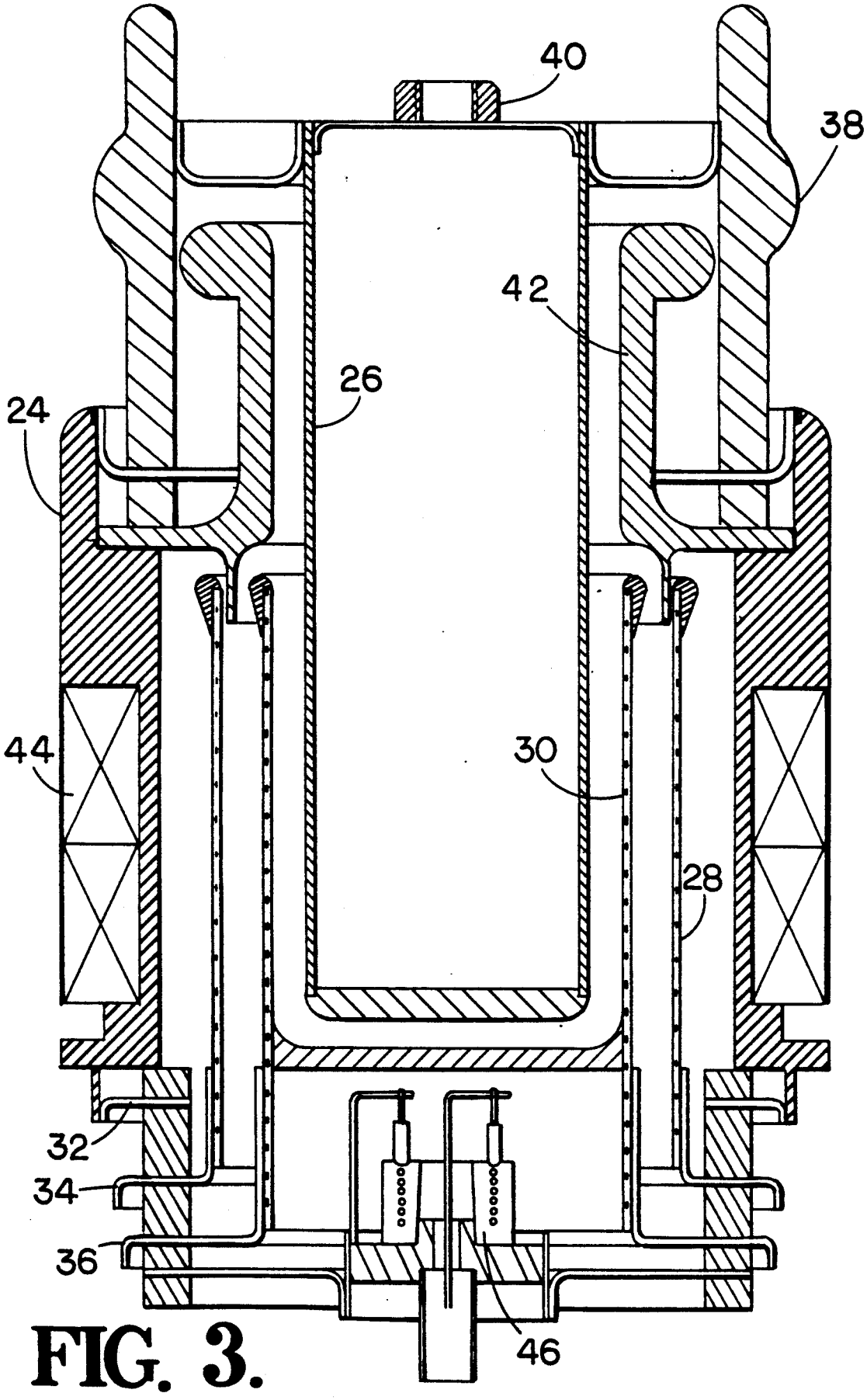
FIG. 3 is a sectional view of a switch assembly which can be adapted to receive the present invention.

A sectional view of a plasma switch that can be adapted to implement the invention is shown in FIG. 3. The invention is also applicable to other devices employing a relatively low voltage drop plasma source, such as ion beam generators and microwave switches. The switch has a generally cylindrical cathode 24 encircling and radially spaced from an anode cylinder 26. A source grid 28 and control grid 30 extend annularly around anode 26, inwardly from cathode 24. Electrical connectors 32, 34 and 36 are provided for the cathode, source grid and control grid, respectively. The anode 26 is mechanically suspended from a bushing 38, and is supplied with voltage signals via electrical connector 40. An upper cathode extension 42 surrounds the upper portion of the anode to avoid a large gap between these elements, and any consequent Paschen breakdown in the vacuum switch. Permanent magnets 44 are positioned within an inset in the outer cathode wall.

A gas reservoir 46 is provided to introduce a low pressure ionizable gas, typically hydrogen, into the switch. The gas diffuses through the interior of the switch and, when ionized into a plasma, forms the conducting medium between the cathode and anode when the switch is closed.

Figure 4:
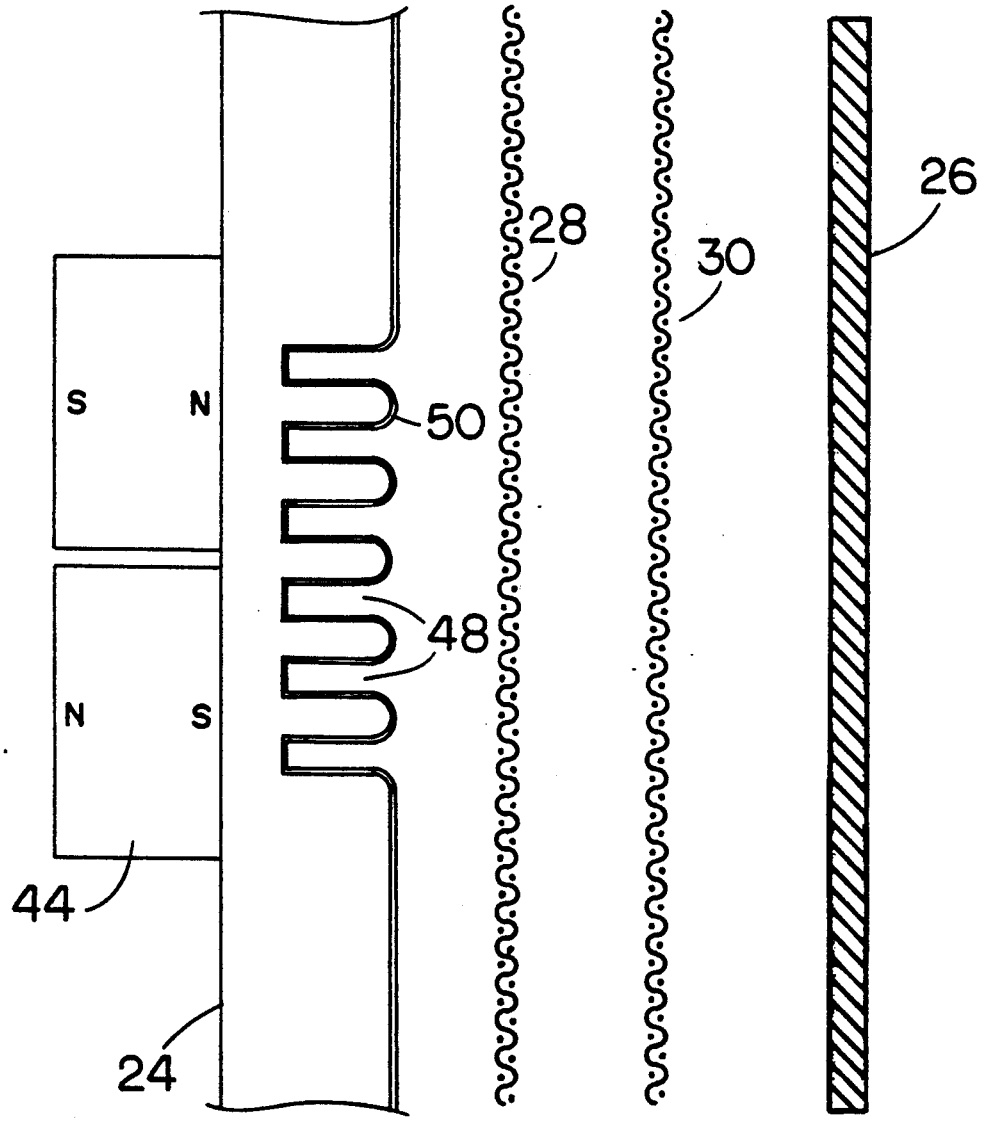
FIG. 4 is a partial sectional view showing one embodiment of the perturbated cathode structure of the present invention and adjacent switch elements.
Figure 5:
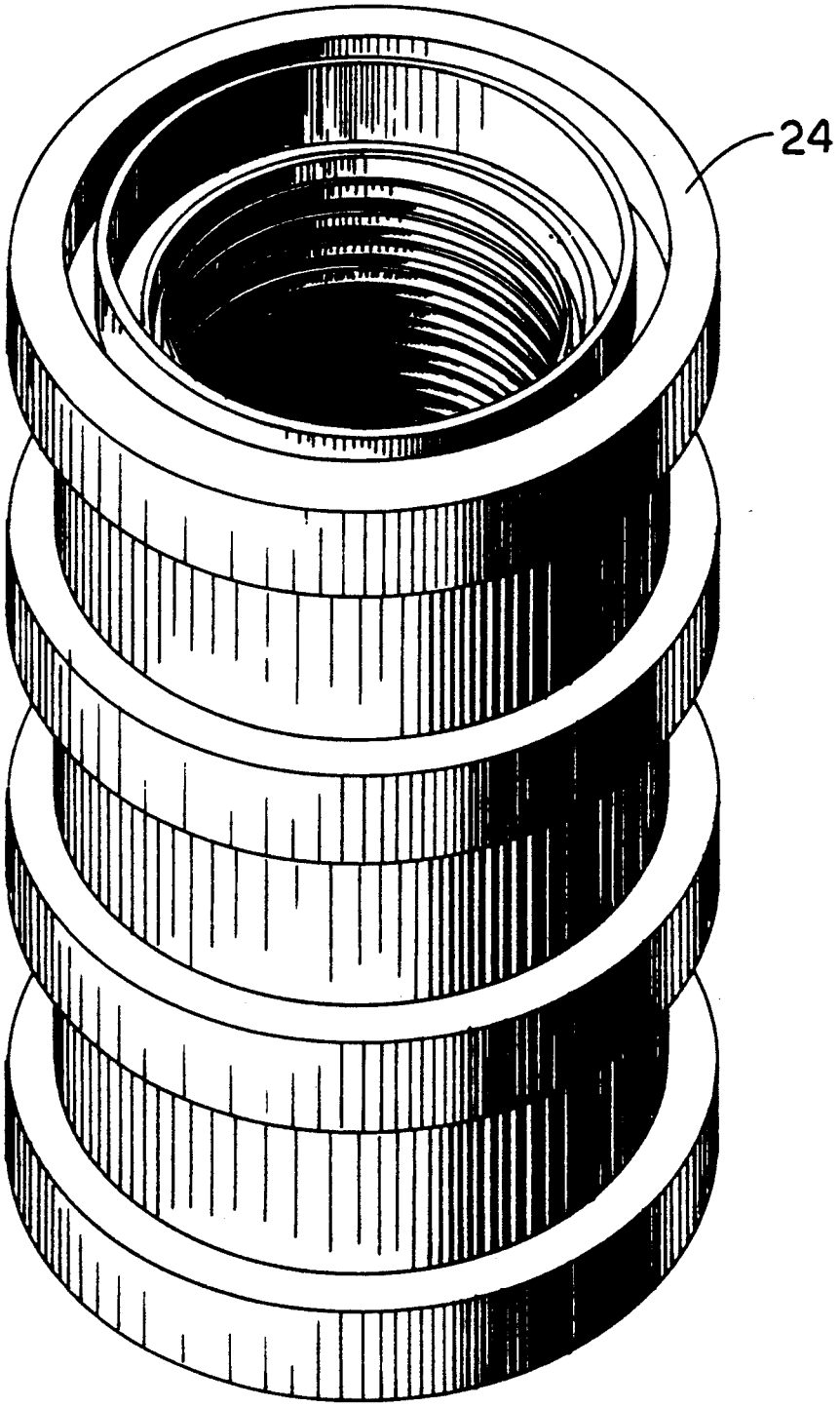
FIG. 5 is a perspective view of the perturbated cathode assembly of FIG. 4.

FIG. 4 is an enlarged diagrammatic view of a section of the improved switch in the vicinity of the magnets 44, while FIG. 5 is a perspective view of the actual cathode structure for this implementation. Rather than having a smooth interior wall as in prior switches, a series of perturbations 48 are formed in the interior cathode wall in the region of the magnets. These perturbations give the cathode wall an irregular surface, and substantially increase the cathode surface area exposed to the plasma in this region. In the embodiment shown the perturbations are provided in the form of a series of parallel grooves extending into the inner wall of the cathode.

Such grooves have been found to provide a significant improvement in the operation of the switch. This is believed to be a result of two basic factors. First, secondary electrons emitted from the cathode surface within the grooves tend to travel back and forth through the plasma within the grooves for a considerable distance before emerging from the grooves into the main plasma area. This produces a significant increase in the average effective path length before the electrons are captured at the anode, and a corresponding increase in the probability of an electron striking and ionizing many gas molecules. Secondary electron confinement has been found to be especially important for efficient plasma production in this type of plasma switch because the switch operates at a relatively low gas pressure, on the order of about 0.1–0.25 Torr, while the gaps between grids, cathode and anode are considerably less than the ionization mean free path (typically less than 1 cm vs. many cm).

Second, the increased cathode surface area significantly reduces the cathode current density for a given absolute current level. The forward voltage drop between the cathode and anode varies in a positive fashion with the cathode current density, and accordingly a reduction in the current density has the desirable effect of reducing the forward voltage drop. Furthermore, there is an absolute limit on the allowable current density, generally in the area of about 10–20 amp/cm$^2$, before arcing can occur. By reducing the cathode current density, the grooves thus also reduce the danger of arcing and significantly increase the peak current that can be carried by the switch. At high current densities the electric field in the cathode sheath is very high. The flat surface between grooves and the large surface radius of each groove fin avoids unnecessary intensification of the field, and helps prevent a glow-to-arc transition.

In one specific implementation, a 9.5 cm diameter cathode was employed with grooves on the inside surface that were 2 mm wide and 9 mm deep. The groove width in general should be greater than twice the thickness of the cathode sheath 14 illustrated in FIG. 2, which is typically about 0.1 mm. While theoretically deeper grooves will produce better performance, in practice the plasma density decreases with groove depth to the point where the plasma may not penetrate to the bottom of the groove. Also, it is difficult to plate the cathode surface as described below if the depth of the grooves is much greater than twice their width.

Another important aspect of the invention is the provision of the electron emissive cathode surface as a chromium or chromium-based coating. Despite a relatively long development history, chromium has not previously been used for the cathode of a plasma switch. However, in accordance with the invention chromium has been found to be a particularly beneficial material for the cathode. Chromium has a high conductivity, and is thus capable of supporting a high current level. It has also been found to have a low sputter yield when exposed to a hydrogen plasma. That is, few chromium atoms are sputtered away by ion impact against the cathode surface. This is an important quality, since sputtered particles can change the operation of the switch and short out its insulation if they accumulate on an insulative surface. Furthermore, sputtered particles can build up over time on adjacent surfaces and flake off to short out the elements upon which the flakes fall.

Aluminum has also been found to be a good cold-cathode secondary electron emitter, but only when it is covered with an oxide layer. The oxide layer reduces the metal's work function and increases the secondary yield. A cold aluminum cathode may operate in a laboratory environment with high secondary yield for long periods of time. However, when the aluminum cathode is operated at a high current density and high average current (1 amp or greater) in a vacuum-sealed enclosure such as the present plasma switch, the oxide layer is sputtered away by plasma ions. The discharge then continues on the bare aluminum surface, which has a lower secondary electron yield. In one example a cold aluminum cathode operated in a laboratory experiment produced a measured forward-voltage drop of only 180 volts. When the same cathode was operated at a high current level in a sealed switch tube, however, the forward-voltage drop increased to 900 volts after the oxide layer was sputtered away. Thus, despite its initial attractiveness, aluminum is not an optimum cold-cathode material for a plasma switch environment.

Another advantage is that chromium has a relatively high melting temperature, permitting the switch to operate at temperatures up to 500°–600° C. Also, it is rather chemically inert to hydrogen, the ionizable gas which is normally employed in the plasma switch. This contrasts with the II through V metals, which are reactive with hydrogen. Chromium is also non-magnetic, and thus permits the field from the magnets on the outside of the cathode to pass through the cathode so as to confine the plasma within the switch.

Chromium is further characterized by a low vapor pressure, making it a good material for a high vacuum device. It does not evaporate off the cathode wall into the interior of the switch, and thus avoids contaminating the switch and interfering with the maintenance of a good vacuum.

Figure 1:
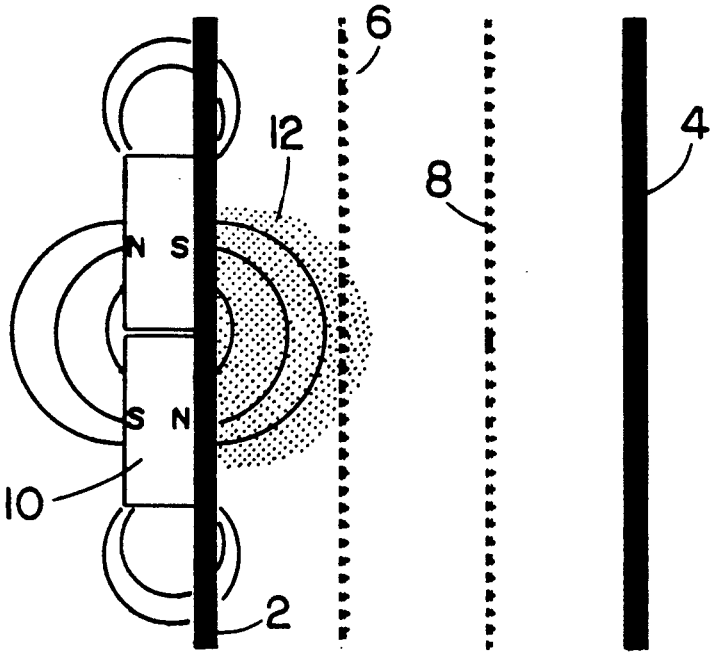
FIG. 1 is a cross-sectional diagram of one-half of a prior art plasma switch.
Figure 2:
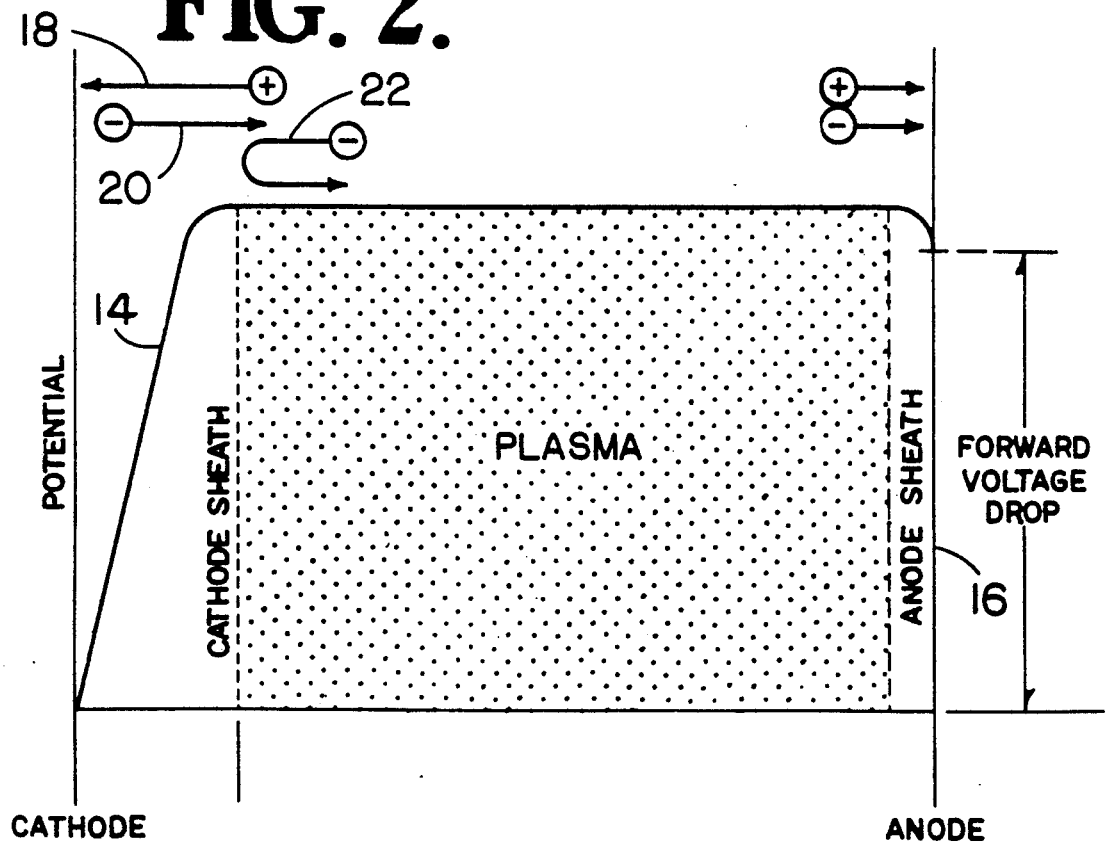
PRIOR ART FIG. 2.
FIG. 2 is a graph illustrating a typical voltage distribution between the cathode and anode of the switch illustrated in FIG. 1.
Figure 6:
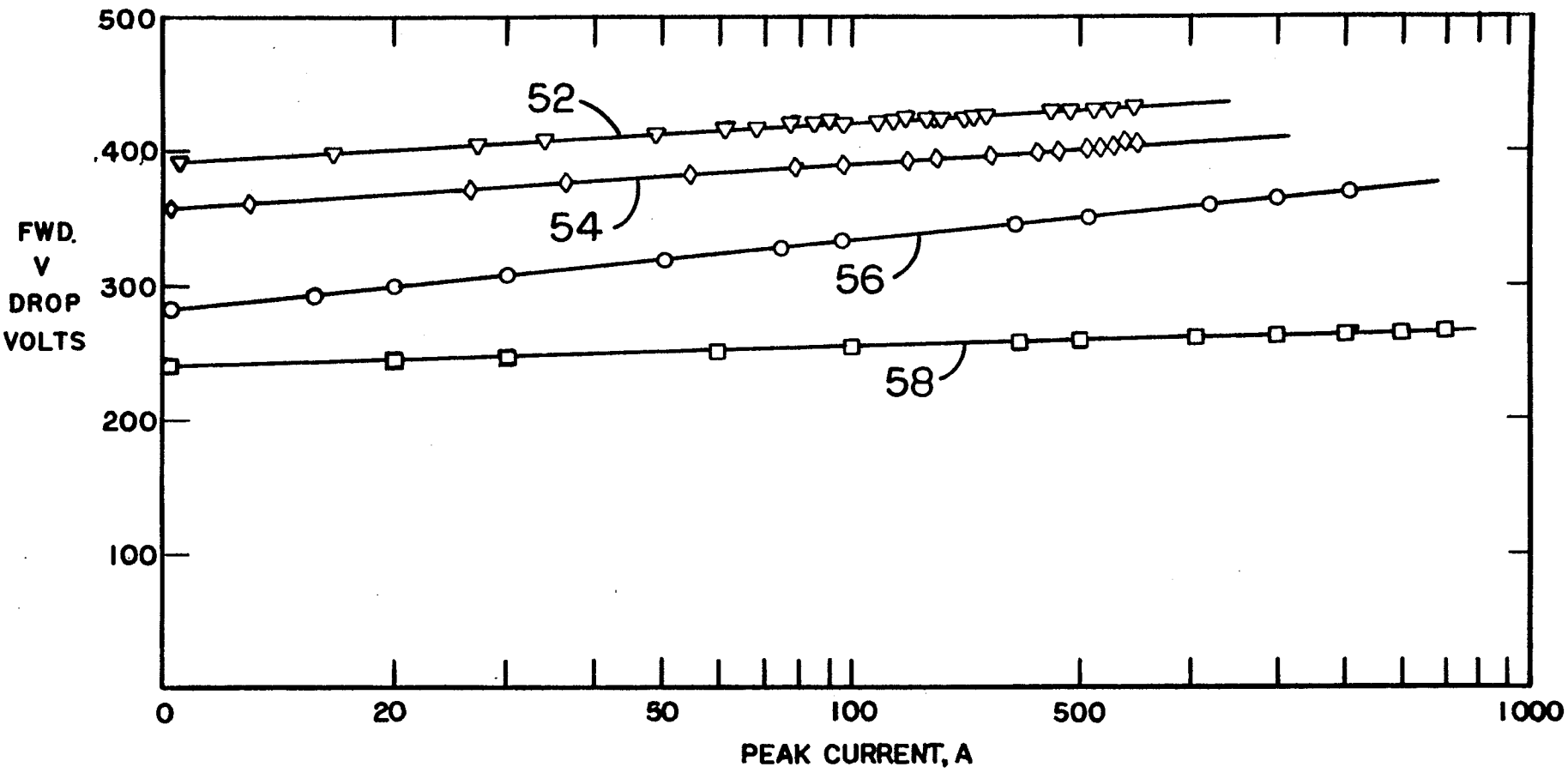
FIG. 6 is a graph comparing the forward voltage drop-peak current characteristics of chromium coated cathodes, both grooved and smooth bored, with cathodes made of other materials.

Referring back to FIG. 4, cathode 24 comprises a base or tube formed from a strong, relatively inexpensive material such as copper or stainless steel, with a layer of chromium 50 electroplated onto the inner surface and coating the grooves 48. In the embodiment described above, a stainless steel base was used with a 75 micron thick layer of chromium. The device was found to exhibit a significantly lower forward voltage drop than prior devices when the cathode was coated with chromium, and an even lower forward voltage drop when both a chromium surface and cathode grooves were employed. These results are shown in the graph of FIG. 6, in which the forward voltage drop is plotted as a function of the peak cathode current. Trace 52 is a plot of the forward voltage drop for a smooth-walled cathode with a thoriated tungsten layer, trace 54 is for a smooth-walled molybdenum coating, trace 56 is for a smooth-walled chromium coating, and trace 58 is for a grooved cathode with a chromium coating. FIG. 2 demonstrates that the forward voltage drop scales in proportion to $\phi_w \ln I_p$, where $\phi_w$ is the work function of the cold cathode material and $I_p$ is the peak current. The ratio of the forward voltage drops for smooth-bore thoriated tungsten, molybdenum and chromium is nearly equal to the ratio of their work functions. Despite the fact that experimentation conducted in connection with the present invention has established chromium as having a high secondary electron yield, it does not suffer from the significant sputtering problem that plagued prior low work function cathode coatings.

The fabrication of a chromium coating on the inner cathode surface also offers considerable advantages. In contrast to the brazing technique previously used to form a molybdenum cathode coating, a chromium layer can be formed on the cathode by a simple and inexpensive electroplating process.

While ordinary platers chromium with a purity in excess of 99% was employed in the demonstration of the invention, various mixtures involving chromium and other materials might also provide useful results. For example, mixing chromium with tungsten, molybdenum and/or thorium might be found to produce a coating with a lower work function, and correspondingly increased secondary electron yield, then either of its constituents taken separately. Also, since oxides generally exhibit a lower work function than corresponding non-oxidized materials, mixing in a proportion of chromium oxide might also produce an even better cathode coating.

Figure 7:
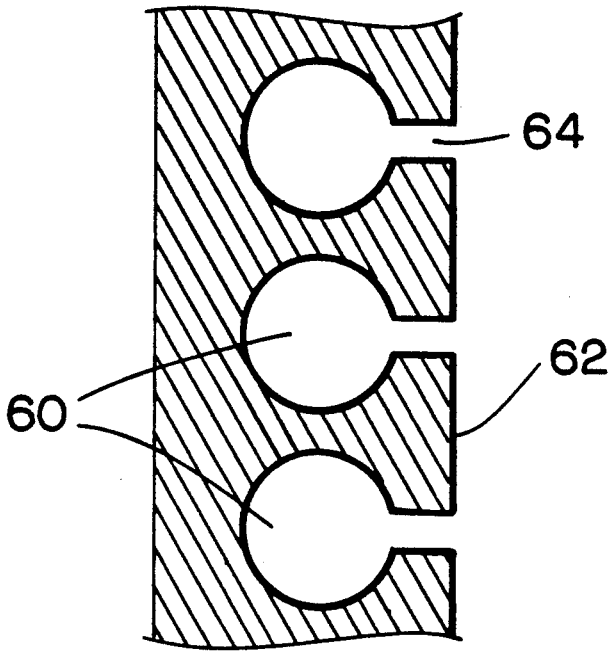
FIGS. 7 and 8 are sectional views of two alternate embodiments in which cavities are formed in the cathode wall rather than smooth grooves.
Figure 8:
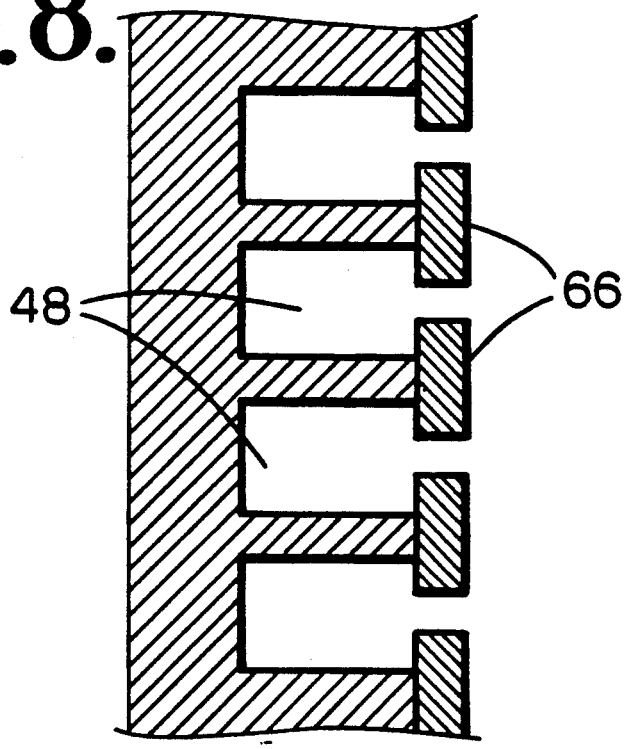

Numerous configurations other than simple annular grooves may be envisioned for the cathode perturbations. Two such variations are illustrated in FIGS. 7 and 8, both involving the provision of annular cavities rather than grooves. In FIG. 7 a series of ring-shaped cavities 60 are formed in the cathode, and open to the interior cathode surface 62 through necks 64. In FIG. 8 the cathode grooves 48 are partially closed by a series of annular crossbars 66, which overlap the inner cathode surface between grooves and extend partially across the groove openings. For the embodiments of both FIGS. 7 and 8, the cavities would be coated with either chromium or a chromium mixture as discussed above. In each case the openings from the cavities to the interior of the switch are substantially smaller than the inside dimensions of the cavities themselves, which serves to further increase the secondary electron path length and the consequent efficiency of the system.

Several embodiments of a novel plasma switch have thus been shown and described. Since numerous variations and alternate embodiments will occur to those skilled in the art, it is intended that the invention be limited only in terms of the appended claims.

I claim:

1. A plasma switch comprising:

a vacuum housing a cold cathode within the housing which provides a source of secondary electrons, an anode spaced from the cathode, a source grid disposed between the anode and cathode within the housing, means for introducing an ionizable gas into the space between the cathode and source grid, said cathode and source grid maintaining a plasma therebetween in response to a predetermined voltage differential between the cathode and source grid, a control grid disposed between said source grid and anode for selectively enabling and terminating a plasma path between the cathode and anode, and thereby closing and opening the switch, in response to control voltage signals applied to the control grid, and a magnet means confining the plasma to a predetermined area between the cathode and anode, said cathode having a series of perturbations which increase the effective cathode surface exposed to the plasma compared to a smooth-walled cathode, said perturbations being shaped to confine secondary electrons emitted from the cathode to increase the average effective path length of said second electrons through the plasma, said perturbations each having a depth suitable for reducing the forward voltage drop of the switch while allowing the plasma to penetrate into the perturbation.

2. The plasma switch of claim 1, said perturbations comprising a series of grooves having substantially parallel side walls.

3. The plasma switch of claim 2, said plasma being characterized by a voltage differential between the cathode and plasma over a cathode sheath region of the plasma, wherein said grooves are substantially wider than twice the width of said cathode sheath.

4. The plasma switch of claim 1, said perturbations comprising cavities in the cathode having openings to the plasma which are substantially smaller than the interiors of said cavities.

5. The plasma switch of claim 4, said cavities comprising a series of grooves in the cathode with a series of cross bars overlapping the cathode surface between grooves and partially closing said grooves.

6. A plasma switch, comprising:

a vacuum housing, a cold cathode within the housing having a surface layer which provides a source of secondary electrons, said cathode surface layer being at least partially formed from chromium, an anode spaced from the cathode within the housing, a source grid disposed between the anode and cathode, means for introducing an ionizable gas into the space between the cathode and source grid, said cathode and source grid maintaining a plasma therebetween in response to a predetermined voltage differential between the cathode and source grid, a control grid disposed between said source grid and anode for selectively enabling and terminating a plasma path between the cathode and anode, and thereby closing and opening the switch, in response to control voltage signals applied to the control grid, and a magnet means confining the plasma to a predetermined area between the cathode and anode.

7. The plasma switch of claim 6, said cathode surface layer being formed at least 99% from chromium.

8. The plasma switch of claim 6, said cathode surface layer being formed from a mixture of chromium and chromium oxide.

9. The plasma switch of claim 6, said cathode surface layer being formed from a mixture of chromium and a material selected from the group consisting of tungsten, molybdenum and thorium.

10. The plasma switch of claim 6, said cathode comprising a base formed from a material other than chromium, with said surface layer plated on said base.

11. A plasma switch, comprising:

a vacuum housing, a cold cathode within the housing having a surface layer which provides a source of secondary electrons, said cathode surface layer being at least partially formed from chromium, an anode spaced from the cathode within the housing, a source grid disposed between the anode and cathode, means for introducing an ionizable gas to the space between the cathode and source grid, said cathode and source grid maintaining a plasma therebetween in response to a predetermined voltage differential between the cathode and source grid, a control grid disposed between said source grid and anode for selectively enabling and terminating a plasma path between the cathode and anode, and thereby closing and opening the switch, in response to control voltage signals applied to the control grid, and a magnet means confining the plasma to a predetermined area between the cathode and anode, said cathode surface layer having a series of perturbations which increase the effective surface layer area compared to a smooth-walled surface layer, said perturbations being shaped to confine secondary electrons emitted from the surface layer to increase the average effective path length of said secondary electrons through the plasma.

12. The plasma switch of claim 11, said perturbations comprising a series of grooves having substantially parallel side walls.

13. The plasma switch of claim 12, said plasma being characterized by a voltage differential between the cathode and plasma over a cathode sheath region of the plasma, wherein said grooves are substantially wider than twice the width of said cathode sheath.

14. The plasma switch of claim 11, said perturbations comprising cavities in the cathode having openings to the plasma which are substantially smaller than the interiors of said cavities.

15. The plasma switch of claim 14, said cavities comprising a series of grooves in the cathode with a series of crossbars overlapping the cathode surface between grooves and partially closing said grooves.

16. The plasma switch of claim 11, said cathode surface layer being formed at least 99% from chromium.

17. The plasma switch of claim 11, said cathode surface layer being formed from a mixture of chromium and chromium oxide.

18. The plasma switch of claim 11, said cathode surface layer being formed from a mixture of chromium and a material selected from the group consisting of tungsten, molybdenum and thorium.

19. The plasma switch of claim 11, said cathode comprising a base formed from a material other than chromium, with said surface layer plated on said base.

20. A cold cathode for providing a secondary electron emission to an adjacent plasma, comprising:

a cathode surface layer being at least partially formed from chromium and a series of perturbations in said cathode which increase the effective cathode surface area exposed to the plasma compared to a smooth-walled surface, said perturbations being shaped to confine secondary electrons emitted from said cathode to increase the effective average path length of said secondary electrons through an adjacent plasma.

21. The cold cathode of claim 20, said perturbations comprising a series of grooves having substantially parallel side walls.

22. The cold cathode of claim 20, said perturbations comprising cavities in the cathode having openings to the plasma which are substantially smaller than the interiors of said cavities.

23. The cold cathode of claim 20, said cavities comprising a series of grooves in the cathode with a series of cross bars overlapping the cathode surface between grooves and partially closing said grooves.

24. A cold cathode for providing a secondary electron emission to an adjacent plasma, comprising:

a cold cathode base member, and a surface layer on said cold cathode base member to be exposed to a plasma, said surface layer being at least partially formed from chromium.

25. The cold cathode of claim 24, said cathode surface layer being formed at least 99% from chromium.

26. The cold cathode of claim 24, said cathode surface layer being formed from a mixture of chromium and chromium oxide.

27. The cold cathode of claim 24, said cathode surface layer being formed from a mixture of chromium and a material selected from the group consisting of tungsten, molybdenum and thorium.

28. The cold cathode of claim 24, said cathode comprising a base formed from a material other than chromium, with said surface layer plated on said base.

29. A cold cathode for providing a secondary electron emission to an adjacent plasma, comprising:

a cold cathode member having a surface layer to be exposed to a plasma, a series of perturbations in said surface layer which increase the effective cathode surface area exposed to the plasma compared to a smooth-walled surface, said perturbations being shaped to confine secondary electrons emitted from said cathode surface layer to increase the average effective path length of said secondary electrons through an adjacent plasma, and said surface layer being at least partially formed from chromium.

30. The cold cathode of claim 29, said perturbations comprising a series of grooves having substantially parallel side walls.

31. The cold cathode of claim 29, said perturbations comprising cavities in the cathode having openings to the plasma which are substantially smaller than the interiors of said cavities.

32. The cold cathode of claim 29, said cavities comprising a series of grooves in the cathode with a series of cross bars overlapping the cathode surface between grooves and partially closing said grooves.

33. The cold cathode of claim 29, said cathode surface layer being formed at least 99% from chromium.

34. The cold cathode of claim 29, said cathode surface layer being formed from a mixture of chromium and chromium oxide.

35. The cold cathode of claim 29, said cathode surface layer being formed from a mixture of chromium and a material selected from the group consisting of tungsten, molybdenum and thorium.

36. The cold cathode of claim 29, said cathode comprising a base formed from a material other than chromium, with said surface layer plated on said base.

* * * * *

UNITED STATES PATENT AND TRADEMARK OFFICE

CERTIFICATE OF CORRECTION

PATENT NO. : 5,019,752

DATED : MAY 28, 1991

INVENTOR(S) : ROBERT W. SCHUMACHER

It is certified that error appears in the above-identified patent and that said Letters Patent is hereby corrected as shown below:

Col. 7, line 52, after the word "surface", insert --area--.

Signed and Sealed this

Fifth Day of October, 1993

Bruce Lehman

*Attest:*

BRUCE LEHMAN

*Attesting Officer*

*Commissioner of Patents and Trademarks*